US010092935B2

(12) United States Patent
Jensen

(10) Patent No.: US 10,092,935 B2
(45) Date of Patent: Oct. 9, 2018

(54) DEVICE AND A METHOD FOR EJECTING A FLUID

(71) Applicant: ALFA LAVAL CORPORATE AB, Lund (SE)

(72) Inventor: Bo Boye Busk Jensen, Rödovre (DK)

(73) Assignee: ALFA LAVAL CORPORATE AB, Lund (SE)

( * ) Notice: Subject to any disclaimer, the term of this patent is extended or adjusted under 35 U.S.C. 154(b) by 894 days.

(21) Appl. No.: 14/385,059

(22) PCT Filed: Mar. 8, 2013

(86) PCT No.: PCT/EP2013/054694

§ 371 (c)(1),
(2) Date: Sep. 12, 2014

(87) PCT Pub. No.: WO2013/135570

PCT Pub. Date: Sep. 19, 2013

(65) Prior Publication Data

US 2015/0053241 A1 Feb. 26, 2015

(30) Foreign Application Priority Data

Mar. 13, 2012 (EP) ..... 12159169

(51) Int. Cl.
*B08B 9/093* (2006.01)
*B05B 3/06* (2006.01)
(Continued)

(52) U.S. Cl.
CPC ..... *B08B 9/093* (2013.01); *B05B 3/028* (2013.01); *B05B 3/0445* (2013.01); *B05B 3/066* (2013.01);
(Continued)

(58) Field of Classification Search
None
See application file for complete search history.

(56) References Cited

U.S. PATENT DOCUMENTS 3,052,574 A 9/1962 Kennedy, Jr. et al.
4,426,233 A * 1/1984 Manabe ..... B08B 9/0933 134/21
(Continued)

FOREIGN PATENT DOCUMENTS

DE 86 14 299 U1 7/1986
EP 0 619 148 A1 10/1994
JP 53-132019 U 10/1978

OTHER PUBLICATIONS

International Search Report (PCT/ISA/210) dated Jun. 10, 2013, by the European Patent Office as the International Searching Authority for International Application No. PCT/EP2013/054694.
(Continued)

*Primary Examiner* — Katelyn B Whatley
(74) *Attorney, Agent, or Firm* — Buchanan Ingersoll & Rooney PC

(57) ABSTRACT

A device and a method for ejecting a fluid are provided. The device comprises a main pipe, a rotatable housing connected to the main pipe and a hub provided with a nozzle. The hub is rotatably connected to the housing. The fluid is arranged to be conveyed through the main pipe and the housing to said nozzle for ejection of the fluid, and the hub is arranged to rotate about an axis arranged with an angle $\alpha$ in relation to a longitudinal axis of the main pipe. The angle $\alpha$ between the axes is arranged to vary between $90-\beta$ and $90+\beta$, $2 \leq \beta \leq 45$, when the housing rotates one revolution.

15 Claims, 3 Drawing Sheets

(51) Int. Cl.

| | |
|---|---|
| ***B05B 3/02*** | (2006.01) |
| ***B05B 3/04*** | (2006.01) |
| ***B08B 9/08*** | (2006.01) |
| ***B05B 15/55*** | (2018.01) |
| *B05B 13/06* | (2006.01) |

(52) U.S. Cl.
CPC ..... *B05B 15/55* (2018.02); *B08B 9/0813* (2013.01); *B08B 9/0936* (2013.01); *B05B 13/0636* (2013.01)

(56) References Cited

U.S. PATENT DOCUMENTS

| | | | | |
|---|---|---|---|---|
| 6,213,135 | B1 * | 4/2001 | Moulder | B08B 9/0936 134/167 R |
| 2010/0186784 | A1 * | 7/2010 | Ross | B05B 3/028 134/167 R |
| 2012/0017951 | A1 * | 1/2012 | Ross | B08B 9/0936 134/168 R |

OTHER PUBLICATIONS

Written Opinion (PCT/ISA/237) dated Jun. 10, 2013, by the European Patent Office as the International Searching Authority for International Application No. PCT/EP2013/054694.
European Search Report completed on Jul. 19, 2012 by the European Patent Office in European Application No. 12 15 9169 (5 pages).

* cited by examiner

DEVICE AND A METHOD FOR EJECTING A FLUID

TECHNICAL FIELD

The invention relates to a device and a method for ejecting a fluid. The device comprises a main pipe, a rotatable housing connected to the main pipe and a hub provided with a nozzle, the hub being rotatably connected to the housing. The fluid is arranged to be conveyed through the main pipe and the housing to the nozzle for ejection of the fluid. The hub is arranged to rotate about an axis arranged with an angle in relation to a longitudinal axis of the main pipe.

BACKGROUND ART

Tanks are used in innumerable applications for storing fluids, especially liquids, of different kinds. When a fluid has been emptied from the tank, it is often desired to clean the tank. The cleaning should remove residues for a number of reasons such as for avoiding cross contamination, for avoiding build up of contamination layers and for preparing the tank for another batch of fluid. The cleaning is typically done by flushing the inside walls of the tank with a cleaning liquid and different devices for performing such flushing is known within the art. Tanks are typically provided with a flushing device (often permanently installed) for performing the tank cleaning.

One type of known flushing devices comprises a pipe fitted, at one end, with a housing provided with a number of nozzles arranged on a hub. The end of the pipe provided with the housing is arranged inside the tank and cleaning liquid is fed through the pipe to the nozzles from which it is ejected towards the tank inside walls. Typically, to optimize the coverage of the tank inside, the housing rotates about a longitudinal axis of the pipe while the hub and the nozzles rotate about an axis perpendicular to the longitudinal axis of the pipe. The jets from the nozzles together form a cleaning pattern on the inside walls of the tank.

Typically, the pipe of the flushing device is soiled by the fluid stored in the tank. Therefore, in connection with the tank cleaning, it is desirable if the flushing device has a function for cleaning also the pipe itself. SE 534 731 discloses a flushing device like the one described above. It comprises a flush head provided with a number of nozzles of which at least one is angled in relation to the pipe such that the pipe is hit by a jet from this nozzle during at least a part of the rotation of the flush head. The pipe is hit by the jet annularly and at a certain height, i.e. at a certain distance from a fixed reference point. An annular pipe area arranged about this height is thereby effectively cleaned. However, the rest of the pipe area is less effectively cleaned. Further, angling of one nozzle in relation to the others result in a change of the cleaning pattern on the tank inside walls which may result in a less effective cleaning of the inside of the tank.

SUMMARY

An object of the present invention is to provide a device and a method for ejecting a fluid which, at least partly, eliminate potential limitations of prior art. The basic concept of the invention is to angle a hub carrying at least one nozzle in relation to a main pipe carrying the housing. Thereby, the main pipe may be hit by a jet from the nozzle in accordance with a pipe cleaning pattern while a tank inside wall may be hit by the jet from the nozzle in accordance with a tank inside wall cleaning pattern. Effective cleaning of both the main pipe and the tank inside wall is thereby enabled.

The device and the method for achieving the object above are defined in the appended claims and discussed below.

A device for ejecting a fluid according to the present invention comprises a main pipe, a rotatable housing connected to the main pipe and a hub provided with a nozzle. The hub is rotatably connected to the housing and the fluid is arranged to be conveyed through the main pipe and the housing to the nozzle for ejection of the fluid. The hub is arranged to rotate about an axis A3 arranged with an angle $\alpha$ in relation to a longitudinal axis A1 of the main pipe. The device according to the present invention is characterized in that the angle $\alpha$ between the axes A1 & A3 is arranged to vary between $90-\beta$ and $90+\beta$, $2 \leq \beta \leq 45$, when the housing rotates one revolution.

The inventive device can be used for tank cleaning in which case the ejected fluid is a suitable cleaning liquid. Then, the housing with hub and nozzle and a part of the main pipe is typically inserted into the tank in such a way that the housing, hub and nozzle can move freely in relation to the inside walls of the tank.

The housing can be either directly or indirectly connected to the main pipe.

Of course the hub can be, and is typically, provided with more than one nozzle.

The hub can be either directly or indirectly connected to the housing.

Since the hub is arranged to rotate about an axis arranged with a variable angle in relation to the longitudinal axis of the main pipe, the main pipe is hit by a jet from the nozzle at varying height, i.e. at a varying distance from a fixed reference point. Thus, a relatively large area of the main pipe, defined by the pipe cleaning pattern, may actually be hit by the jet which is advantageous from a cleaning point of view. Further, since the jet is caused to hit the main pipe by angling the rotation axis of the hub instead of angling a nozzle, the tank inside wall cleaning pattern remains the same and is only angled or shifted. Thereby, the efficiency of the cleaning of the inside of the tank remains.

The length of the main pipe is typically between 0.5 and 3 meters even if main pipe lengths outside this range are possible.

Each angle $\beta$ results in a specific pipe cleaning pattern extending between a lower extreme point and a higher extreme point on the main pipe and having a max impact zone within which the density of the jet hits on the main pipe is the highest. The larger the angle $\beta$ is, the closer to the hub the lower extreme point, the higher extreme point and the max impact zone are. A jet hitting the main pipe may clean the main pipe, not only at the hitting point, but also below the hitting point since the cleaning liquid, due to gravity, will flow down the main pipe. Thus, a jet hitting the main pipe at a larger distance from the hub may contribute more to the overall cleaning of the main pipe than a jet hitting the main pipe at a smaller distance from the hub.

With an angle $\beta$ fulfilling the condition $2 \leq \beta \leq 45$, the jet hits on a main pipe of typical length as specified above may be relatively many and relatively well spread across the main pipe. Also, within this angle interval, the lower and higher extreme points, as well as the max impact zone, of the pipe cleaning pattern may be suitably arranged for effective cleaning of the main pipe. If $\beta$ instead was outside the above angle interval, the jet hits on the main pipe could be fewer and less spread across the main pipe. Further, a larger angle $\beta$ could result in a pipe cleaning pattern with a lower extreme point, a higher extreme point and a max impact zone located relatively close to the hub, which could be disadvantageous as regards the main pipe cleaning efficiency. Also, a smaller angle β could result in a higher extreme point and possibly also a max impact zone and possibly also a lower extreme point located beyond the main pipe, which could be disadvantageous as regards the main pipe cleaning efficiency. One revolution is equal to 360 degrees.

The device according to the present invention may be so constructed that the housing is rotatably connected to the main pipe. Such a construction enables rotation of the housing in relation to the main pipe which can be stationary and circumferentially hit by a jet from the nozzle.

According to one embodiment of the present invention, a direction of fluid ejection from the nozzle is essentially perpendicular to the axis about which the hub is arranged to rotate. This arrangement is advantageous since it contributes to even, well-covering and effective cleaning patterns.

The inventive device can be so constructed that the housing is arranged to rotate about an axis A2 arranged with an angle $\gamma \neq 0$ in relation to the longitudinal axis A1 of the main pipe. Since the hub is connected to the housing, this construction enables automatic angling of the hub as desired. In other words, in accordance with this embodiment, a known housing conventionally provided with a hub and nozzles can principally be arranged angled in relation to the main pipe to achieve the desired effect.

The device according to the present invention may further comprise a connection part arranged between the main pipe and the housing. The connection part can be formed integrally with the main pipe or as a separate part. The connection part can be directly or indirectly connected to the main pipe and housing, respectively. In accordance with this embodiment, the desired angling of the rotation axis of the hub can be obtained by incorporating a connection part of suitable design into the device, which connection part connects the housing to the main pipe. Such a construction is relatively mechanically simple and inexpensive since already existing components can be used to a very large extent.

The connection part can be designed in many different ways. As an example, it may comprise a bent pipe having a first end directly or indirectly connected to the main pipe and a second end directly or indirectly connected to the housing. According to this example, the connection part is a bent extension of the main pipe which enables a relatively cheap and straightforward construction of the inventive device.

The device can be arranged such that a rotational speed of the housing differs from a rotational speed of the hub. Such an arrangement is advantageous since it enables particularly well-covering pipe and tank inside wall cleaning patterns in that more spots on both the pipe and the tank inside wall are hit by the jet from the nozzle. A method for ejecting fluid according to the present invention comprises the step of providing a main pipe, a rotatable housing connected to the main pipe and a hub provided with a nozzle, where the hub is rotatably connected to the housing. The method further comprises the steps of conveying the fluid through the main pipe, further through the housing and to the nozzle, ejecting the fluid through the nozzle and rotating the hub about an axis A3 arranged with an angle α in relation to a longitudinal axis A1 of the main pipe. The method is characterized in further comprising the step of varying the angle α between the axes A1 & A3 between $90-\beta$ and $90+\beta$, $2 \leq \beta \leq 45$, when the housing rotates one revolution.

BRIEF DESCRIPTION OF THE DRAWINGS

The invention will now be described in more detail with reference to the appended schematic drawings, in which.

DETAILED DESCRIPTION

Figure 1:
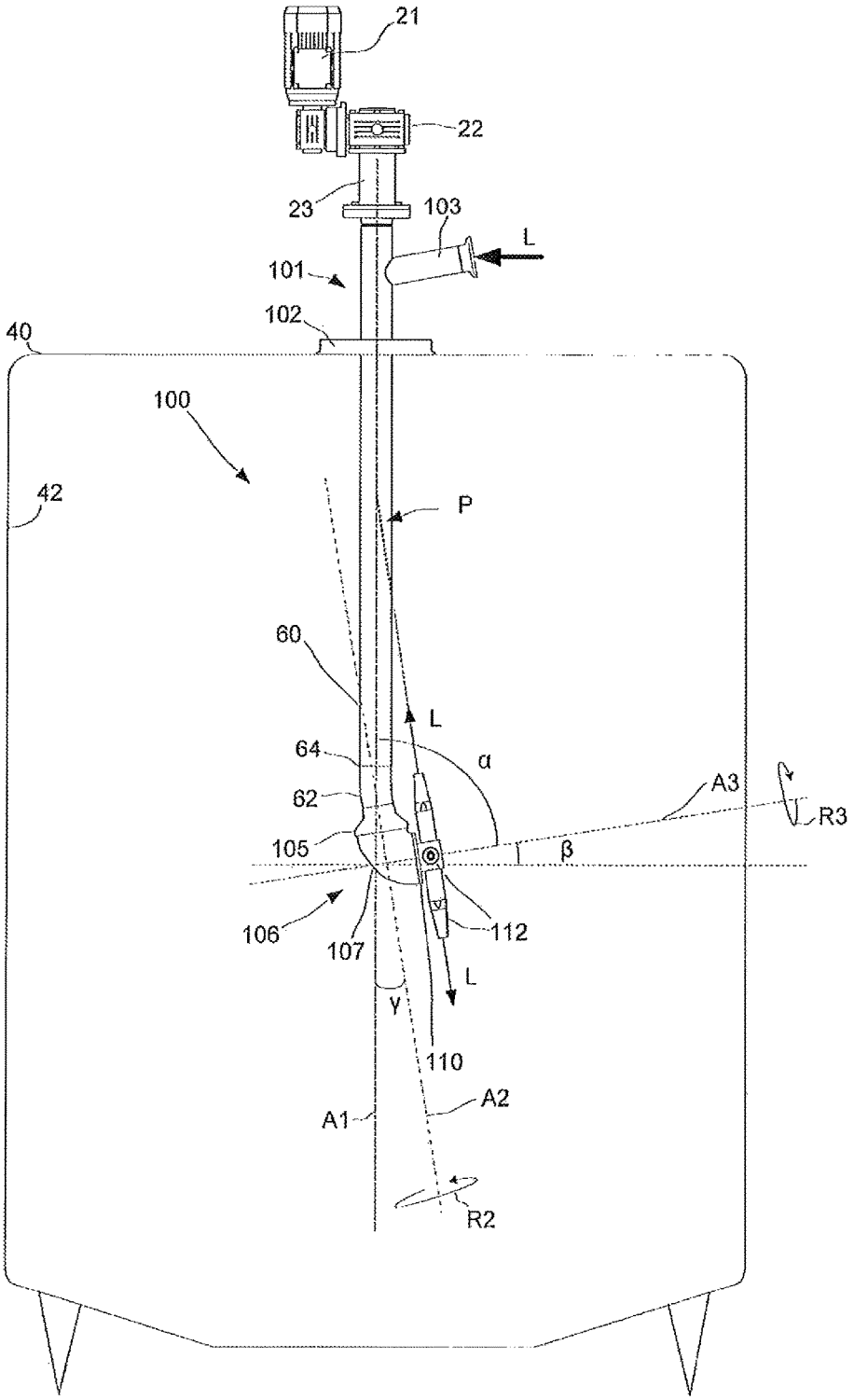
FIG. 1 is a schematic view of a device according to one embodiment of the present invention arranged inside a container.

With reference to FIG. 1 a device 100 arranged to eject a fluid in a tank or container 40 is illustrated. Here, the fluid is a cleaning liquid L which is to be sprayed onto inside walls 42 of the container for cleaning of the same. The device 100 comprises a liquid supply pipe 101 that extends into the container 40 via an opening in an upper part of the same, and a flange 102 that provides a secure connection as well as a tight seal to the container 40. The liquid supply pipe 101 is composed of a straight main pipe 60 with a first and second end and a connection part in the form of a bent pipe 62 with a first and second end. The first end of the bent pipe 62 is connected to the second end of the main pipe 60 along a joint 64. The main pipe 60 has a straight longitudinal axis A1. The bent pipe 62 has a curved longitudinal axis. Extending outwards from the first end of the bent pipe 62 forming the joint 64 with the main pipe 60, the bent pipe longitudinal axis is parallel to A1. Extending outwards from the second end of the bent pipe 62, the bent pipe longitudinal axis is parallel to an axis A2, A1 and A2 being arranged with an angle γ in relation to each other.

An upper part of the liquid supply pipe 101 that is outside the container 40 has an inlet 103 for receiving the cleaning liquid L. A lower part of the liquid supply pipe 101 that extends into the container 40 has at its end, which is the second end of the bent pipe 62, a connection flange 105 to which a rotary head 106 is connected. The rotary head 106 comprises a housing 107 that is rotatable around the axis A2 with a rotational speed $v_{housing}$. To make the housing 107 rotatable in relation to the connection flange 105, a conventional bearing (not visible) is arranged in between the connection flange and an inlet end of the housing that faces the connection flange.

The rotary head 106 also comprises a hub 110 on which a number of liquid ejection nozzles 112 are arranged. In the illustrated embodiment four nozzles are symmetrically arranged on the rotary hub 110 even though it is possible to have e.g. only one nozzle, or more than four nozzles, on the rotary hub 110. The hub 110 is rotatable around an axis A3 with a rotational speed $v_{hub}$. The rotational speed of the housing, $v_{housing}$, is lower than the rotational speed of the hub, $v_{hub}$, as will be further discussed below. To make the hub 110 rotatable in relation to the housing 107, a conventional bearing (not visible) is arranged in between the hub and an outlet end of the housing that faces the hub. The hub 110 is so connected to the housing 107 that the axis A3 is essentially perpendicular to the axis A2. Thus, the rotary hub 110 and the nozzles 112 are able to rotate in a direction R2 about the axis A2 and in a direction R3 about the axis A3, as seen relative the liquid supply pipe 101 or relative the container 40.

The inlet 103 and the liquid supply pipe 101 each have the principal shape of a conventional pipe and are capable of transporting the cleaning liquid L to be ejected into the container 40. The cleaning liquid L, which is provided from a supply unit (not shown), enters the inlet 103 and is conveyed through the main pipe 60 and the bent pipe 62 to the rotary head 106. Further, the cleaning liquid is conveyed through the housing 107 to the rotary hub 110 which distributes the cleaning liquid to the nozzles 112. Finally, the nozzles 112 eject the cleaning liquid towards the inside walls 42 of the container 40 to clean the same.

The rotation in the direction R2 about the axis A2 is accomplished by means of a conventional shaft (not visible or discussed in detail), provided with some suitable joint means to accommodate to the bent pipe 62, which shaft extends inside the liquid supply pipe 101, from an upper end thereof, which is the first end of the main pipe 60, to the rotary head 106 where it is connected to the housing 107. When the shaft is rotated, the housing 107 and thereby the rotary head 106 are rotated in the direction R2.

The liquid supply pipe 101 is connected to a connection piece 23, in turn, connected to a gearbox 22. Further, the shaft is connected to the gearbox 22, which in turn is connected to the drive unit 21. The drive unit 21 is here a conventional electrical motor, but other types of motors such as a pneumatic motor may be used just as well. When the drive unit 21 is activated, it generates a rotation of the shaft and thereby a rotation of the housing 107 in the direction R2. The liquid supply pipe 101 and the connection flange 105 are arranged to be stationary.

To accomplish the rotation in the direction R3, a conventional bevel gear (not visible or discussed in detail) is arranged inside the housing 107. One part of the bevel gear is fixed to the connection flange 105 and another part of the bevel gear is fixed to the hub 110. As the housing 107 rotates, interaction between the gear parts generates the rotation of the hub 110 in the direction R3. Thus, there is a clear connection between the rotation of the housing and the rotation of the hub resulting in certain pipe and tank inside wall cleaning patterns.

Thus, during the tank cleaning process, cleaning liquid L is supplied to the inlet 103 and the drive unit 21 rotates the shaft. Thereby, the housing 107 rotates about the axis A2 and the hub 110 rotates about the axis A3 during ejection of a respective jet of cleaning liquid from each of the nozzles 112. The jets from the nozzles hit the inside walls 42 of the tank or container 40 in accordance with the tank inside wall cleaning pattern, and the liquid supply pipe 101 in accordance with the pipe cleaning pattern, which, as above mentioned, are defined inter alia by the rotational speeds of the housing 107 and the hub 110 which are determined by the output of the drive unit 21. Desirable are cleaning patterns that covers as much as possible of the tank inside surface and the pipe surface, respectively, during as little time as possible.

Figure 2:
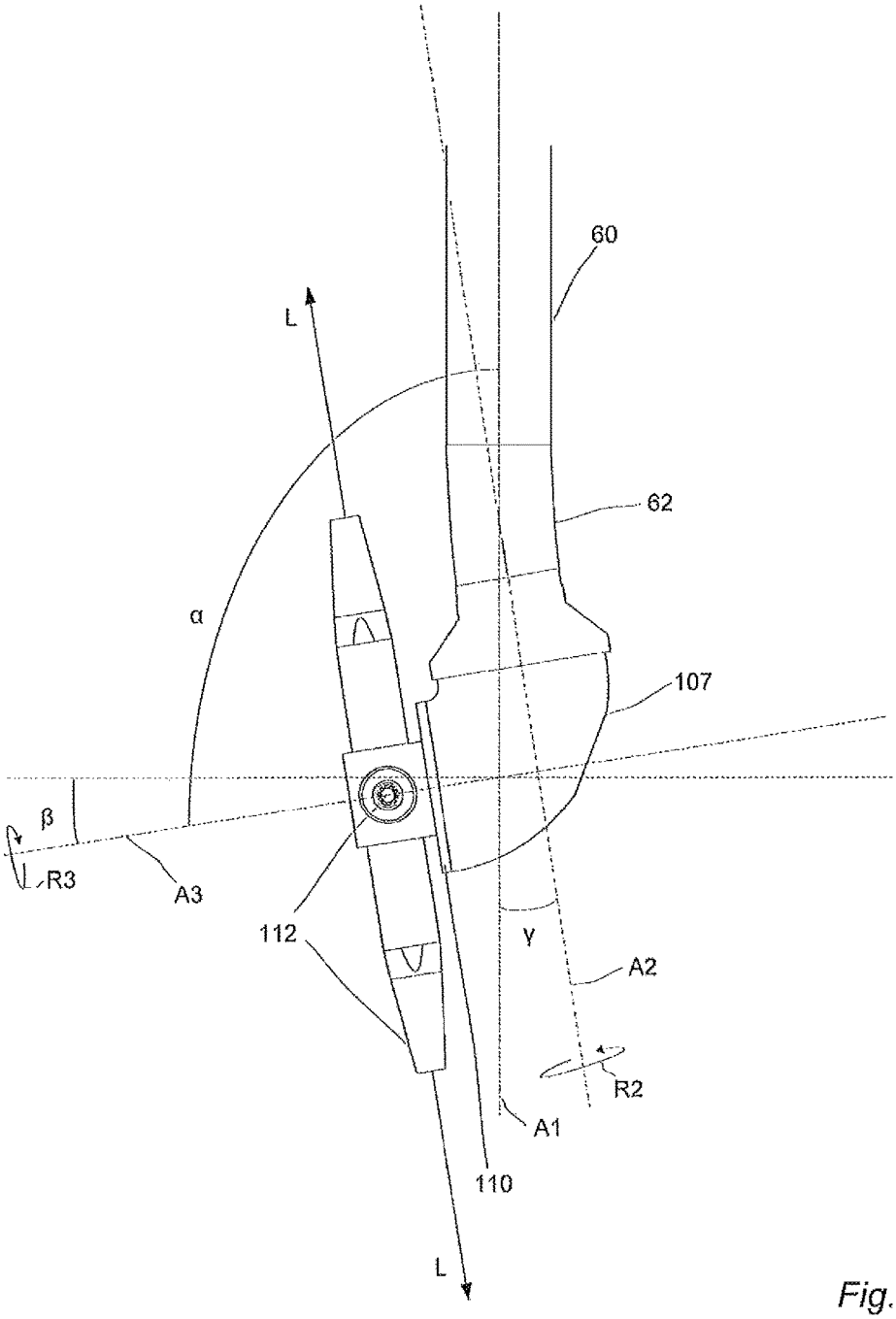
FIG. 2 is an enlargement of a part of the device in FIG. 1.

Because of the bent pipe 62, the axis A2 of rotation of the housing 107 is offset by the angle $\gamma$ in relation to the normally horizontal longitudinal axis A1 of the main pipe 60. Thus, when the housing 107 rotates, an angle $\alpha$ between the rotation axis A3 of the hub 110 and the longitudinal axis of the main pipe 60 will vary. More particularly, the angle $\alpha$ will vary between two extreme values illustrated in FIGS. 1 and 2, respectively. In FIG. 1 the angle $\alpha$ is at its least, i.e. $\alpha=90-\beta$ degrees, where $2\leq\beta\leq45$. In FIG. 2 the angle $\alpha$ is at its largest, i.e. $\alpha=90+\beta$ degrees. $\beta$ varies when the housing 107 rotates in relation to the connection flange 105 and it specifies how much the rotation axis A3 of the hub 110 is offset in relation to a vertical plane. FIGS. 1 and 2 illustrate when $\beta$ is at its largest and then $\beta=\gamma$. Halfway between the housing positions illustrated in FIGS. 1 and 2, i.e. when the housing is rotated 90 and 270 degrees, respectively, in relation to the position illustrated in FIG. 1, $\beta$ is at its least and equal to 0.

Thus, as apparent from the figures, during the tank cleaning process, the jets from the nozzles 112 will not only hit the inside walls 42 of the tank or container 40 but also the liquid supply pipe 101 of the device 100 for cleaning of the same. The liquid supply pipe 101 will not be constantly hit by the jets—it is the momentary position of the nozzles 112, i.e. the momentary position of the housing 107 and the hub 110, that determines whether the liquid supply pipe 101 is hit by the jets or not.

When the housing 107 is arranged in the position illustrated in FIG. 1, the liquid supply pipe 101 is hit by the jets from the nozzles 112. As the housing 107 and hub 110 rotates, the jets will hit the liquid supply pipe at different heights, i.e. different portions of the liquid supply pipe surface as illustrated by the circles P in FIG. 1, which circles extend correspondingly on the other side of the liquid supply pipe (not visible).

Which portion of the liquid supply pipe 101 that is directly hit by the jets is naturally dependent upon the value of the angle $\beta$. As an example, $10\leq\beta\leq30$ degrees. When choosing an appropriate value of $\beta$, the specific design of the device is taken into consideration. As an example, the length of the liquid supply pipe may be considered when setting the value of $\beta$; a relatively large $\beta$ value is typically appropriate for a relatively short liquid supply pipe and vice versa.

As apparent from FIG. 1, quite a large portion of the liquid supply pipe 101 is directly hit by the jets and thereby effectively cleaned and this portion extends both in the longitudinal (height) and the circumferential direction of the liquid supply pipe. Also portions of the liquid supply pipe not directly hit by the jets will still be cleaned by the jets since the cleaning liquid of the jets will spread across the liquid supply pipe with an initial relatively high flow rate. A high flow rate means cleaning with an relatively strong mechanical force which makes the cleaning more effective.

Thus, the device 100 can be realized by modifying a commercially available and well-working cleaning device providing a known effective cleaning pattern. The modifications may involve the provision of a bent pipe between the connection flange 105 and the main pipe 60 and mechanical adjustments required for adaptation to the bent pipe. The proven effective cleaning pattern of the device may remain without changes and may just be provided angled as compared to prior art to achieve one pipe cleaning pattern and one tank inside wall cleaning pattern. Thus, effective cleaning of the tank is assured. Further, the device 100 automatically and effectively cleans the liquid supply pipe when cleaning the tank inside which removes the need for further liquid supply pipe cleaning means requiring additional components and an increased consumption of cleaning liquid.

As previously discussed, the pipe and tank inside wall cleaning patterns result from the gearing provided by the bevel gear built-into the housing 107, more particularly the relation between the rotational speed of the housing, $v_{housing}$, and the rotational speed of the hub, $v_{hub}$. In the above described embodiment $v_{housing}<v_{hub}$. As an example, the device could have gearing of 45 to 43 meaning that after one revolution of the housing, the hub has rotated 1,047 revolutions. This gives cleaning patterns that starts over again in the same path after 43 revolutions of the housing and 45 revolutions of the hub. If the gearing was 1 to 1, the cleaning patterns would start over again after every revolution of the housing, i.e. for every revolution of the housing, e.g. the liquid supply pipe would be hit in the same spots. With a gearing a to b, where a≠b, the liquid supply pipe and the tank inside wall will be hit in many more spots. Taking the 45 to 43 gearing example and the liquid supply pipe, during an interval of 43 revolutions of the housing, the liquid supply pipe will be hit in a first set of spots during a first revolution, a second set of spots during a second revolution, a third set of spots during a third revolution, etc., where the first, second, third, etc. sets differ from each other. Not until the next 43 revolution interval, the liquid supply pipe will again be hit in the same sets of spots. Thereby, a well-covering, both circumferentially and longitudinally, pipe cleaning pattern is achieved. Naturally, the same reasoning is valid also for the tank inside wall cleaning pattern.

Figure 3:
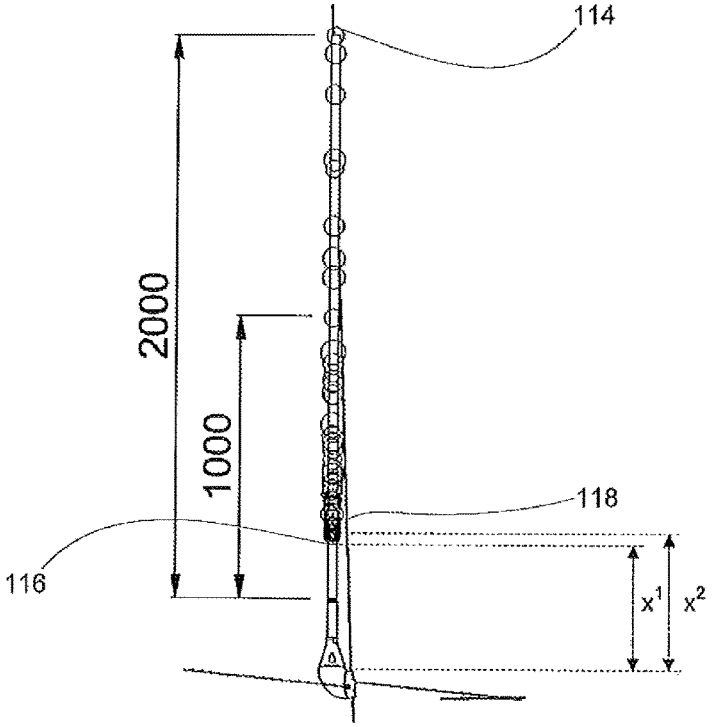
FIG. 3 illustrates the result of a simulation of a pipe cleaning pattern for a first value of β.

FIG. 3 illustrates the result of a simulation of the pipe cleaning pattern achieved by means of a device according to the present invention on a main pipe of approximately 2 meters length when the value of the angle β is 10 degrees. This pipe cleaning pattern has a higher extreme point 114, a lower extreme point 116 and a max impact zone 118. The higher extreme point 114 is positioned at the top of the main pipe while the lower extreme point 116 and the max impact zone 118 are positioned on distances $x^1$ and $x^2$, respectively, from the hub of the device. This pipe cleaning pattern enables a very effective cleaning of the entire main pipe. More particularly, the cleaning liquid from all jet hits will flow along different extensions of the main pipe and contribute to the cleaning thereof. Also, the jet hits are distributed along the entire main pipe.

Figure 4:
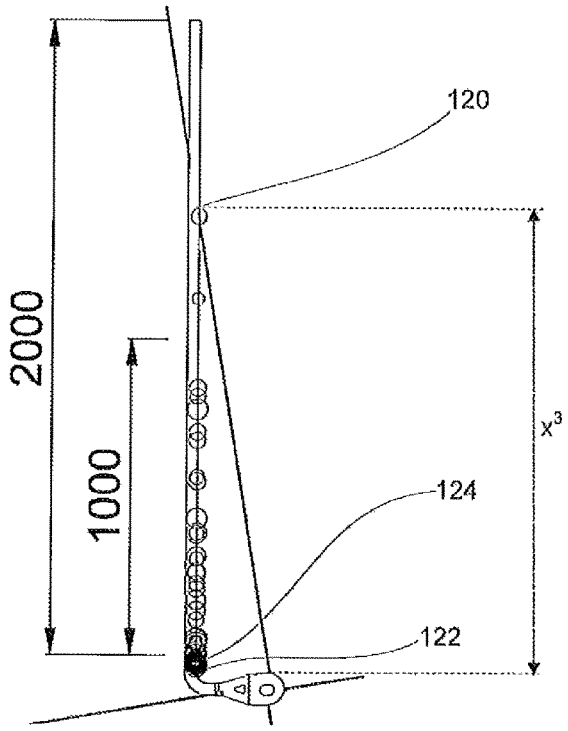
FIG. 4 illustrates the result of a simulation of a pipe cleaning pattern for a second value of β.

FIG. 4 illustrates the result of a simulation of the pipe cleaning pattern if the value of the angle β instead was 90 degrees. This pipe cleaning pattern has a higher extreme point 120, a lower extreme point 122 and a max impact zone 124. The higher extreme point 120 is positioned at a distance $x^3<2$ meters from the hub of the device while the lower extreme point 122 and the max impact zone 124 both are positioned almost in line with the hub of the device. This pipe cleaning pattern enables a less effective cleaning of the main pipe. More particularly, the part of the main pipe extending beyond the higher extreme point 120 cannot be reached with this pipe cleaning pattern. Also, most jet hits will not contribute to the cleaning of the main pipe beyond the hub of the device.

The above described embodiments of the present invention should only be seen as examples. A person skilled in the art realizes that the embodiments discussed can be varied and combined in a number of ways without deviating from the inventive conception.

For example, above, a connection part in the form of a bent pipe 62 connectable to the straight main pipe 60 to form the liquid supply pipe 101, has been used to achieve the angling of the housing, hub and nozzles required for the liquid supply pipe cleaning. Of course, the liquid supply pipe could be formed in one piece, i.e. as one single pipe having a straight portion and a bent portion. Further, the connection part can naturally be of other types, for example be shaped differently or be constructed differently, e.g. as a hollow joint.

Additionally, instead of using a particular connection part to achieve the desired angling of the housing, the connection flange 105 could instead be formed so as to provide this angling whereby the connection part could be omitted. For example, such an embodiment could be realized by a connection flange having a non-linear longitudinal axis similar to the curved longitudinal axis of the bent pipe 62.

Further, according to the above described embodiment the device is so constructed that the rotation axis A3 of the of the hub 110 is essentially perpendicular to the rotation axis A2 of the housing 107. Naturally, the device could also be so constructed that the rotation axes A2 and A3 are non-perpendicular in relation to each other.

The device above is so arranged that the rotational speed of the housing, $v_{housing}$, is lower than the rotational speed of the hub, $v_{hub}$. Naturally, the device could instead be arranged in the opposite way such that the rotational speed of the housing, $v_{housing}$, is higher than the rotational speed of the hub, $v_{hub}$. As an additional alternative, that might not result in equally well-covering cleaning patterns, the rotational speed of the housing, $v_{housing}$, could be equal to the rotational speed of the hub, $v_{hub}$.

Finally, in the above described device the housing 107 is connected to the shaft extending inside the liquid supply pipe 101. Further, the shaft is connected to the gear box 22, in turn, connected to the drive unit 21. The shaft, and thereby the housing, is rotated by the drive unit 21. Naturally, the housing could be rotated in other ways than by means of an external drive unit and a shaft. For example, the device could comprise a turbine built into the housing 107, which turbine drives a planet gear, for accomplishing the rotation of the housing. Such a construction is described in detail in WO 92/04994, which document, in its entirety, is incorporated herein by reference.

It should be stressed that a description of details not relevant to the present invention has been omitted and that the figures are just schematic and not drawn according to scale.

The invention claimed is:

1. A device for ejecting a fluid comprising:

a main pipe;

a rotatable housing connected to the main pipe;

a hub provided with a nozzle, the hub being rotatably connected to the housing;

the fluid being arranged to be conveyed through the main pipe and the housing to the nozzle for ejection of the fluid;

the hub being arranged to rotate about an axis oriented at an angle α in relation to a longitudinal axis of the main pipe;

a connection part arranged between the main pipe and the housing, the connection part comprising a bent pipe, a first end of which is connected to the main pipe and a second end of which is connected to the housing; and the angle α between the axis of the hub and the longitudinal axis of the main pipe being arranged to vary between 90−β and 90+β, 2≤β≤45, when the housing rotates one revolution, such that the main pipe is hit by the fluid from the nozzle at a varying height.

2. A device according to claim 1, wherein the housing is rotatably connected to the main pipe.

3. A device according to claim 1, wherein a direction of fluid ejection from the nozzle is essentially perpendicular to the axis about which the hub is arranged to rotate.

4. A device according to claim 1, wherein the housing is arranged to rotate about an axis arranged with an angle γ≠0 in relation to the longitudinal axis of the main pipe.

5. A device according to claim 1, wherein a rotational speed of the housing differs from a rotational speed of the hub.

6. A fluid ejecting device positioned in an interior of a tank or container, the tank or container including an inside wall, the fluid ejecting device comprising:

a main pipe positioned in the interior of the tank or container, the main pipe possessing a longitudinal axis and a longitudinal extent;

a rotatable housing connected to the main pipe to rotate about a housing rotation axis relative to the main pipe and positioned in the interior of the tank or container;

a bent pipe possessing one end connected to the main pipe and an opposite end connected to the housing;

a rotatable hub rotatably connected to the housing so that the rotatable hub rotates relative to the housing about a hub rotation axis, the rotatable hub being positioned in the interior of the tank or container;

a nozzle arranged on the rotatable hub to rotate together with the rotatable hub;

the main pipe, the housing, the bent pipe, the rotatable hub and the nozzle being configured so that fluid introduced into the main pipe is conveyed through the main pipe, through the rotatable housing, through the bent pipe and through the rotatable hub, and is ejected through the nozzle; and the hub rotation axis forming an angle $\alpha$ in relation to the longitudinal axis of the main pipe, the angle $\alpha$ between the hub rotation axis and the longitudinal axis of the main pipe varying between $90-\beta$ and $90+\beta$, $2\leq\beta\leq45$, when the housing rotates one revolution, so that the fluid ejected by the nozzle hits the main pipe at different locations along the longitudinal extent of the main pipe.

7. The fluid ejecting device positioned in the interior of the tank or container according to claim 6, wherein the housing is rotatably connected to the main pipe.

8. The fluid ejecting device positioned in the interior of the tank or container according to claim 6, wherein the nozzle is configured so that the fluid ejected from the nozzle is essentially perpendicular to the hub rotation axis.

9. The fluid ejecting device positioned in the interior of the tank or container according to claim 6, wherein the housing rotation axis forms an angle $\gamma\neq0$ relative to the longitudinal axis of the main pipe.

10. The fluid ejecting device positioned in the interior of the tank or container according to claim 6, wherein the hub rotation axis is essentially perpendicular to the housing rotation axis.

11. A method for ejecting a fluid comprising providing a main pipe, a rotatable housing connected to the main pipe and a hub provided with a nozzle, said hub being rotatably connected to the housing, conveying the fluid through said main pipe, further through the housing and to said nozzle, ejecting the fluid trough the nozzle, rotating the hub about an axis arranged with an angle $\alpha$ in relation to a longitudinal axis of the main pipe, providing a connection part between the main pipe and the housing, the connection part including a bent pipe between the main pipe and the housing, a first end of the bent pipe being connected to the main pipe and a second end of the bent pipe being connected to the housing, and varying the angle $\alpha$ between the axes between $90-\beta$ and $90+\beta$, $2\leq\beta\leq45$, when the housing rotates one revolution, such that the main pipe is hit by the fluid from the nozzle at a varying height.

12. A method according to claim 11, comprising ejecting the fluid through the nozzle in a direction essentially perpendicular to the axis about which the hub is rotated.

13. A method according to claim 11, comprising rotating the housing in relation to the main pipe about an axis.

14. A method according to claim 11, comprising providing the axis with an angle $\gamma\neq0$ in relation to the longitudinal axis of the main pipe.

15. A method according to claim 11, comprising rotating the housing and the hub with different rotational speeds.

* * * * *